US007186128B1

(12) United States Patent
Wu

(10) Patent No.: US 7,186,128 B1
(45) Date of Patent: Mar. 6, 2007

(54) SIMPLE-STRUCTURED PLUG FOR INSERTION SLOTS OF VARIOUS SPECIFICATIONS

(76) Inventor: Sung-Chiang Wu, 235 Chung-Ho Box 8-24, Taipei (TW)

( * ) Notice: Subject to any disclaimer, the term of this patent is extended or adjusted under 35 U.S.C. 154(b) by 0 days.

(21) Appl. No.: 11/401,489

(22) Filed: Apr. 11, 2006

(51) Int. Cl.
*H01R 4/50* (2006.01)

(52) U.S. Cl. ..... 439/344

(58) Field of Classification Search ..... 439/344, 439/354, 385, 355, 345
See application file for complete search history.

(56) References Cited

U.S. PATENT DOCUMENTS 5,613,869 A * 3/1997 Erlich et al. ..... 439/344
6,179,643 B1 * 1/2001 Fukuda ..... 439/358
6,364,685 B1 * 4/2002 Manning ..... 439/357

* cited by examiner

*Primary Examiner*—Phuong Dinh

(57) ABSTRACT

A simple-structured plug for insertion slots of various specifications includes an insulating body having a plurality of terminal slots at a front end thereof for receiving a plurality of terminals; the insulating body having a buckle; at least one tenon being formed on the insulating body; wherein when the plug is inserted into a wide insertion hole, the tenon will press against the insertion hole so that the plug will not vibrate, and thus the plug is suitable for insertion holes of various specifications. The tenon is one of a protruding block, an elastic sheet and a positioning device. The insertion hole is one of an RJ 11 hole and an RJ 45 hole. At another design, a tenon assembly protrudes from the buckle and at least one tenon is formed on the tenon assembly.

6 Claims, 8 Drawing Sheets

SIMPLE-STRUCTURED PLUG FOR INSERTION SLOTS OF VARIOUS SPECIFICATIONS

FIELD OF THE INVENTION

The present invention relates to plugs, and in particular to a simple-structured plug for insertion slots of various specifications, wherein a plug is suitable for insertion holes of various specifications.

BACKGROUND OF THE INVENTION

Generally, computer data transmission devices are installed with RJ45 insertion holes or RJ11 insertion holes. Referring to FIG. 1, the plug 1 has an insulating body 11. The insulating body 11 has a press buckle 12. A front end of the insulating body 31 has a plurality of terminal slots 13. A conductive wire 14 inserts into a rear side of the insulating body 31. The insulating body 31 clamps the conductive wire 14 and pierces into the insulating outer layer of the conductive wire 14 so as to electrically connect thereto. The RJ 11 plug is then inserted into a RJ 11 slot 15. A width "a" of the plug is only suitable for the RJ11 insertion hole 15. Referring to FIG. 2, a perspective view of a prior art RJ 45 plug is illustrated. The plug has an insulating body 21. The insulating body 21 has a buckle 22. A front end of the insulating body 21 has a plurality of terminal slots 23. A conductive wire 24 can insert into a rear side of the insulating body 21. The insulating body 21 clamps the conductive wire 24 and pierces the outer insulating layer of the insulating body 24 to electrically connect thereto. Then the RJ 45 plug 2 can insert into the RJ45 insertion hole 25 and a width b of the plug is only suitable for the RJ11 insertion hole 25.

The RJ11 insertion hole and RJ45 insertion hole have different specifications. Thus the plug cannot be used. Thus, one plug is only suitable for one specification. The plugs of different specifications must be made. The molds for the insulating bodies are also different. Two molds are necessary and thus the manufacturing process is increased.

However the RJ 11 plug and RJ 45 plug are frequently used in the current network communication devices and thus users must prepare the plugs of different specifications. This causes inconvenience to users.

SUMMARY OF THE INVENTION

Accordingly, the primary object of the present invention is to provide a simple-structured plug for insertion slots of various specifications, wherein a plug is suitable for insertion holes of various specification.

To achieve above object, the present invention provide a simple-structured plug for insertion slots of various specifications which includes an insulating body having a plurality of terminal slots at a front end thereof for receiving a plurality of terminals; the insulating body having a buckle; at least one tenon being formed on the insulating body; wherein when the plug is inserted into a wide insertion hole, the tenon will press against the insertion hole so that the plug will not vibrate, and thus the plug is suitable for insertion holes of various specifications. The tenon is one of a protruding block, an elastic sheet and a positioning device. The insertion hole is one of an RJ 11 hole and an RJ 45 hole. At another design, a tenon assembly protrudes from the buckle and at least one tenon is formed on the tenon assembly.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
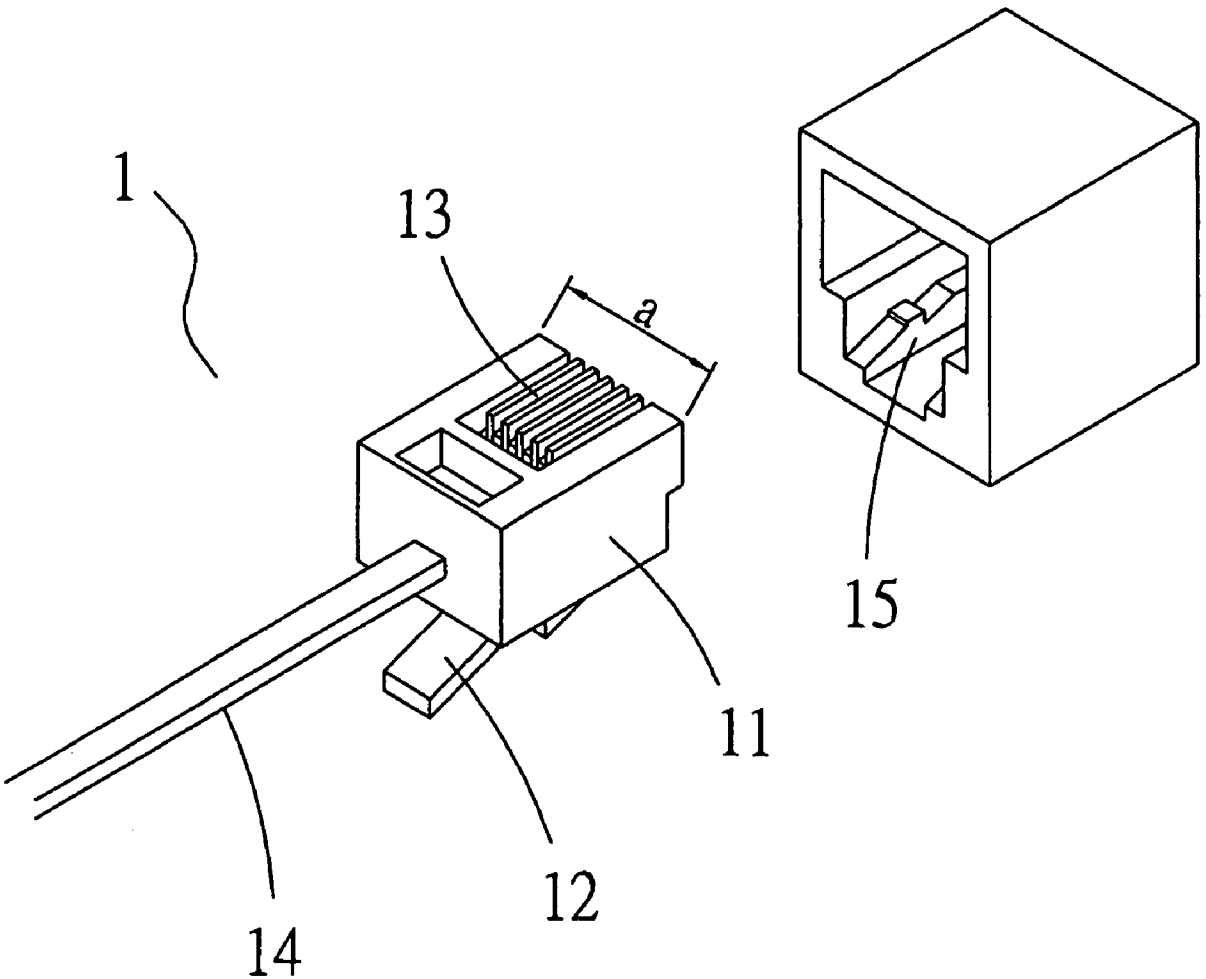
Fig. 1 (Prior Art)
FIG. 1 is a perspective view of a prior art RJ 11 telephone wire plug.
Figure 2:
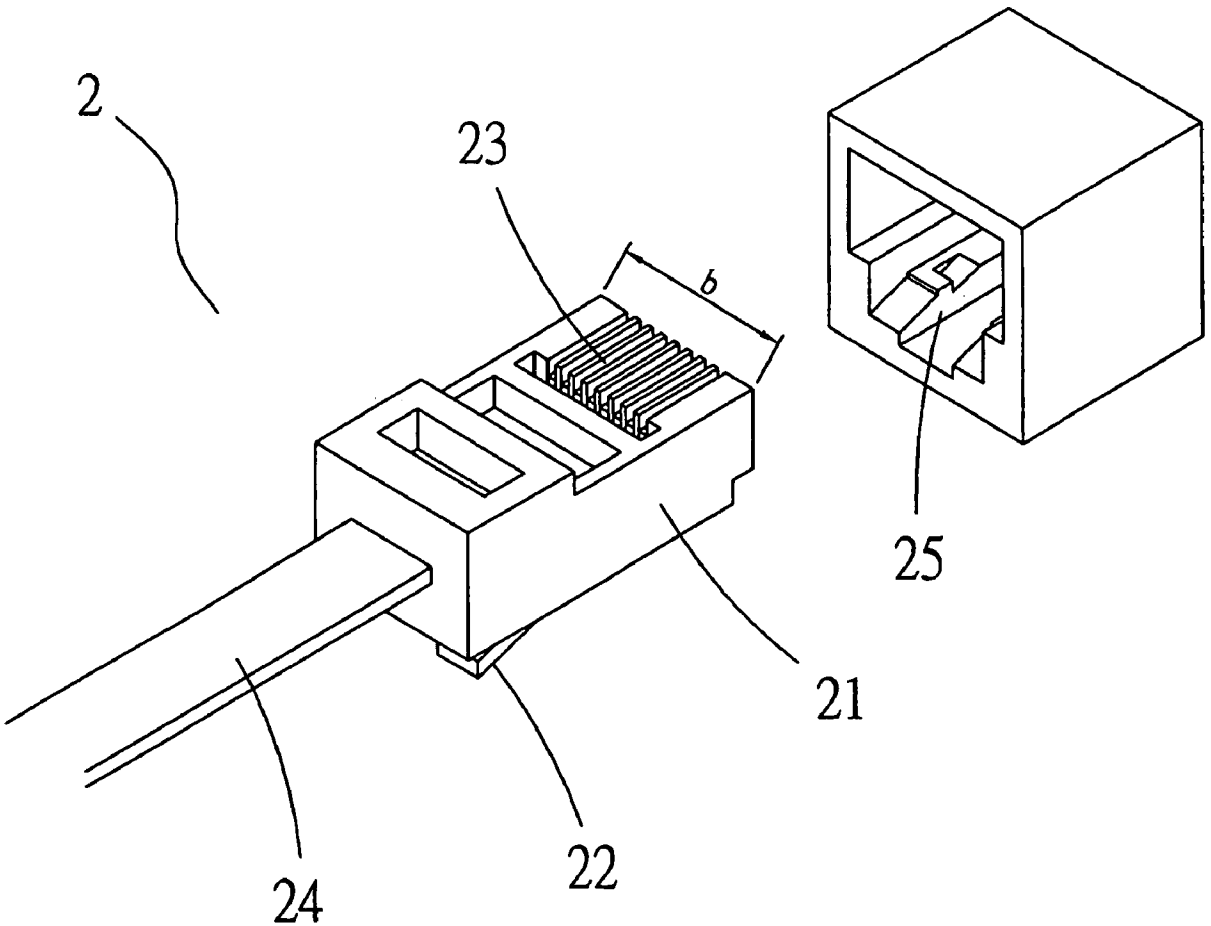
Fig. 2 (Prior Art)
FIG. 2 is a perspective view of a prior art RJ 45 network wire plug.
Figure 3:
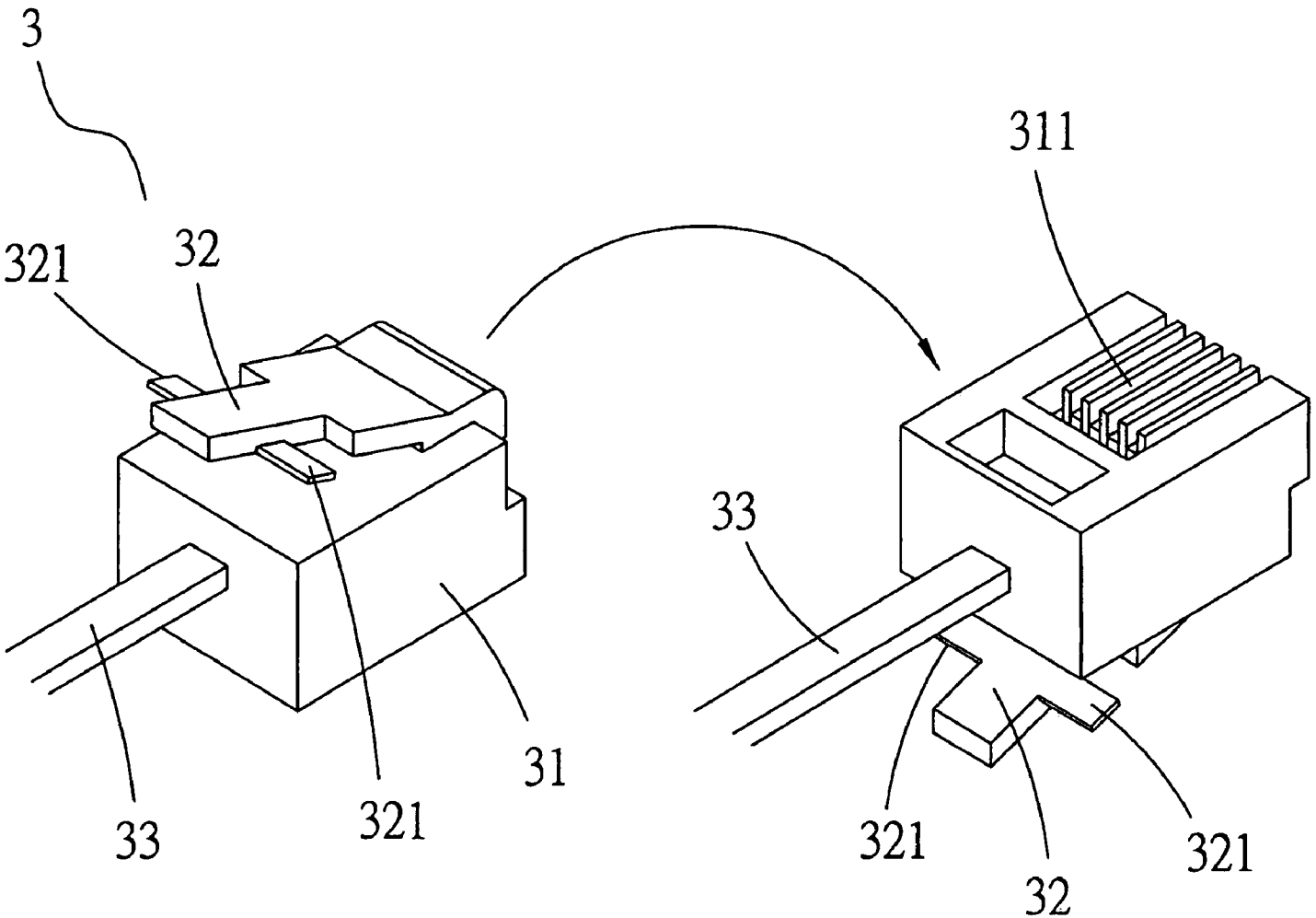
FIG. 3 is a perspective view of the simple-structured plug for insertion slots of various specifications of the present invention.

Referring to FIG. 3, the simple-structured plug for insertion slots of various specifications 3 of present invention is illustrated. The present invention has the following elements.

An insulating body 31 has a plurality of terminal slots 311 at a front end thereof. A rear side of the insulating body 31 is connected to a conductive wire 33. The insulating body 31 has a T shape buckle 32. Two tenons 321 are extended on a longitudinal portion of the buckle 32.

Figure 4:
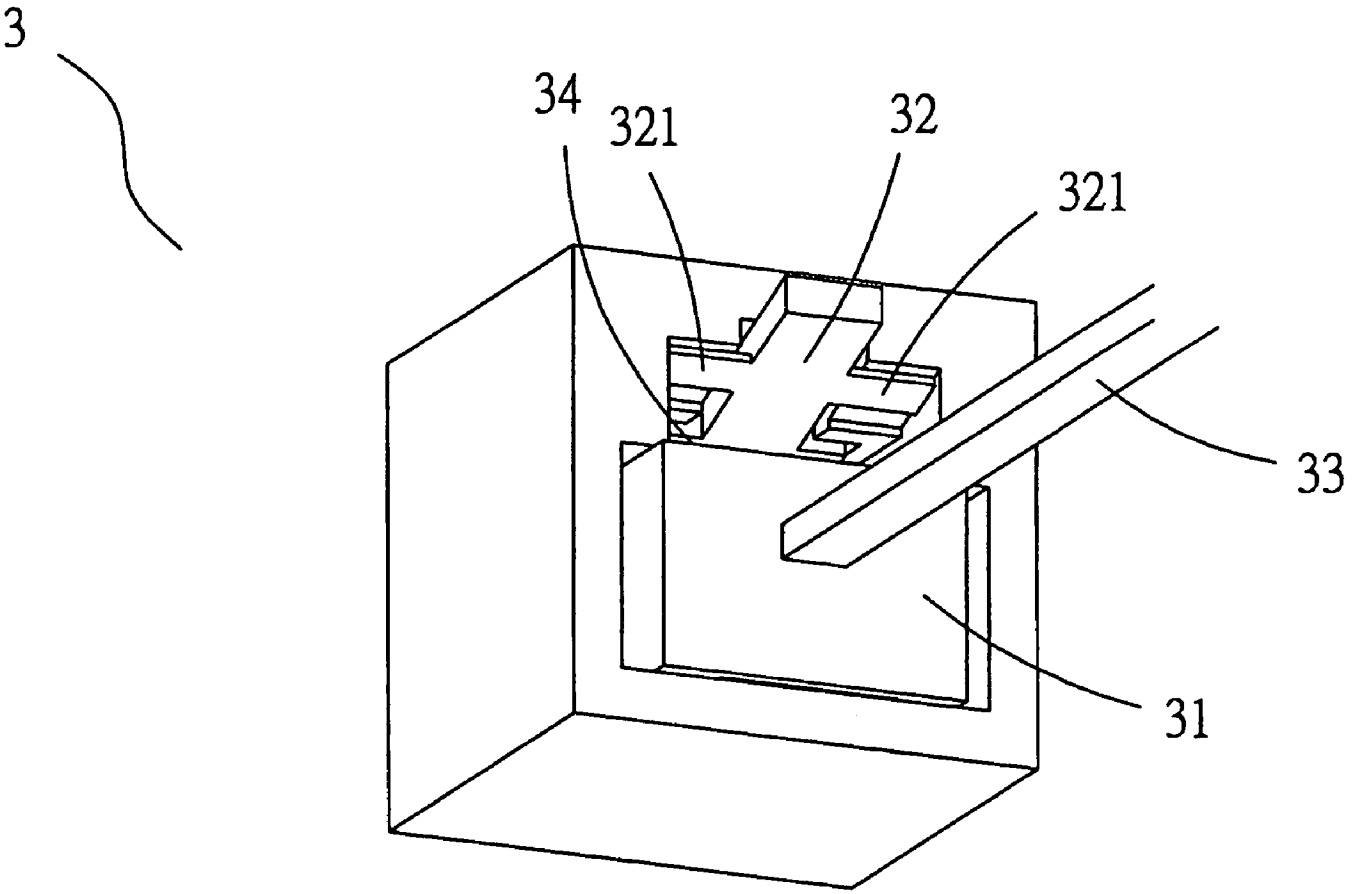
FIG. 4 is a schematic view of the simple-structured plug for insertion slots of various specifications of the present invention.
Figure 5:
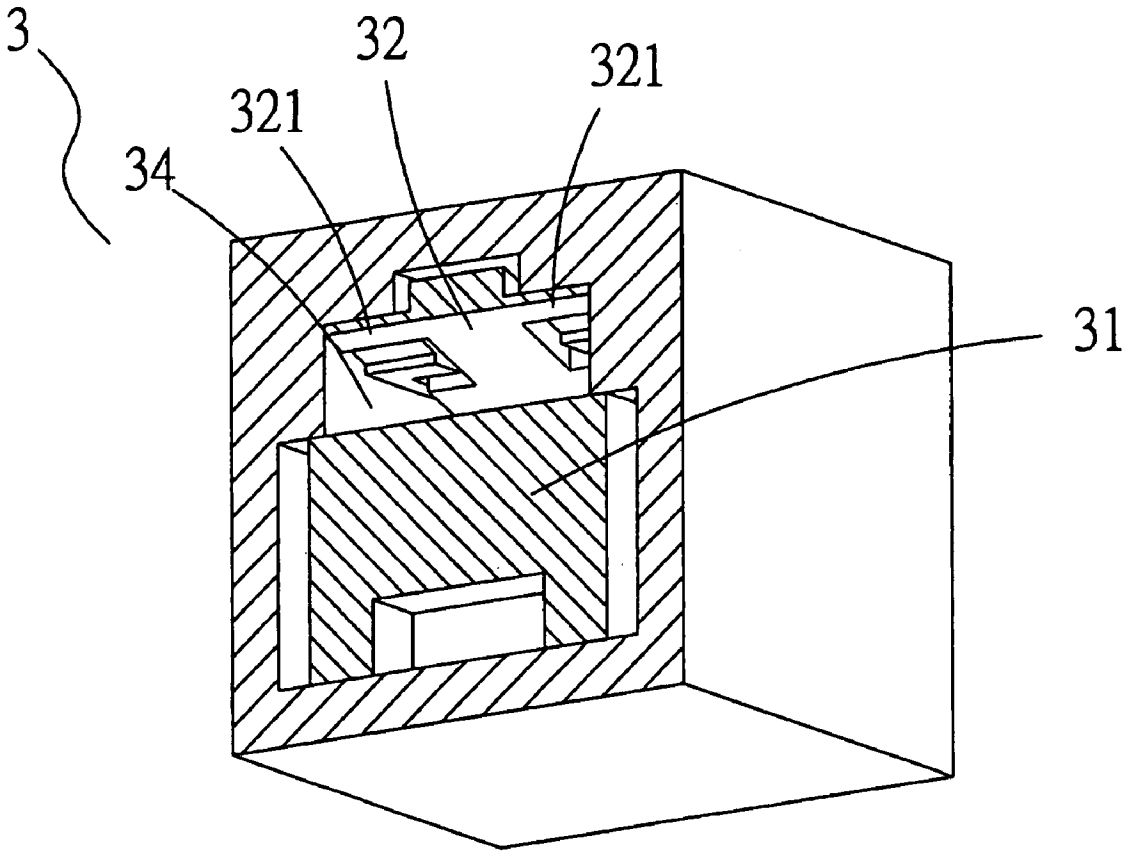
FIG. 5 is a cross sectional view of the simple-structured plug for insertion slots of various specifications of the present invention.

Referring to FIGS. 4 and 5, when the simple-structured plug for insertion slots of various specifications 3 of the present invention is inserted into an RJ 45 insertion hole 34, the buckle 32 has been positioned in a predetermined position. The two tenons 321 will press against the insertion hole 34 so as to support the insulating body 31 steadily without movement. Thereby the present invention is suitable of the RJ45 insertion hole 34.

Figure 6:
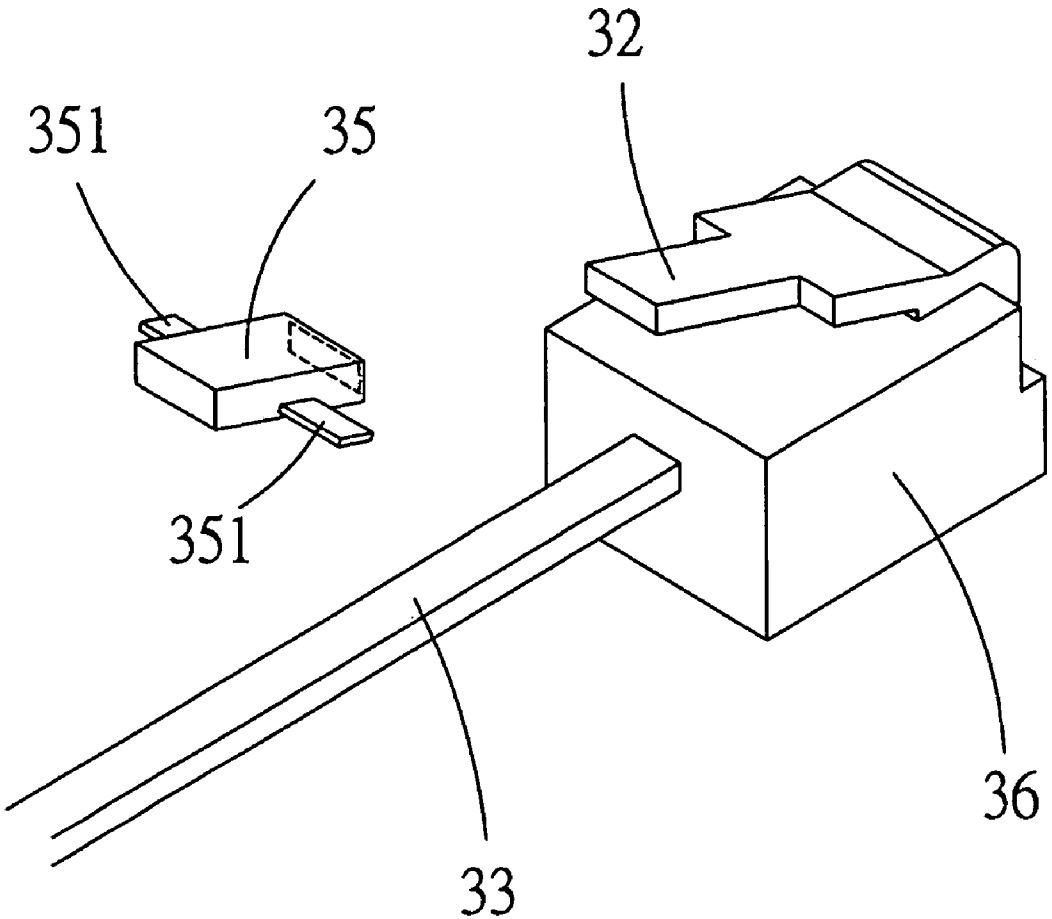
FIG. 6 is a perspective view showing the tenon assembly and the RJ 11 plug according to the present invention.
Figure 7:
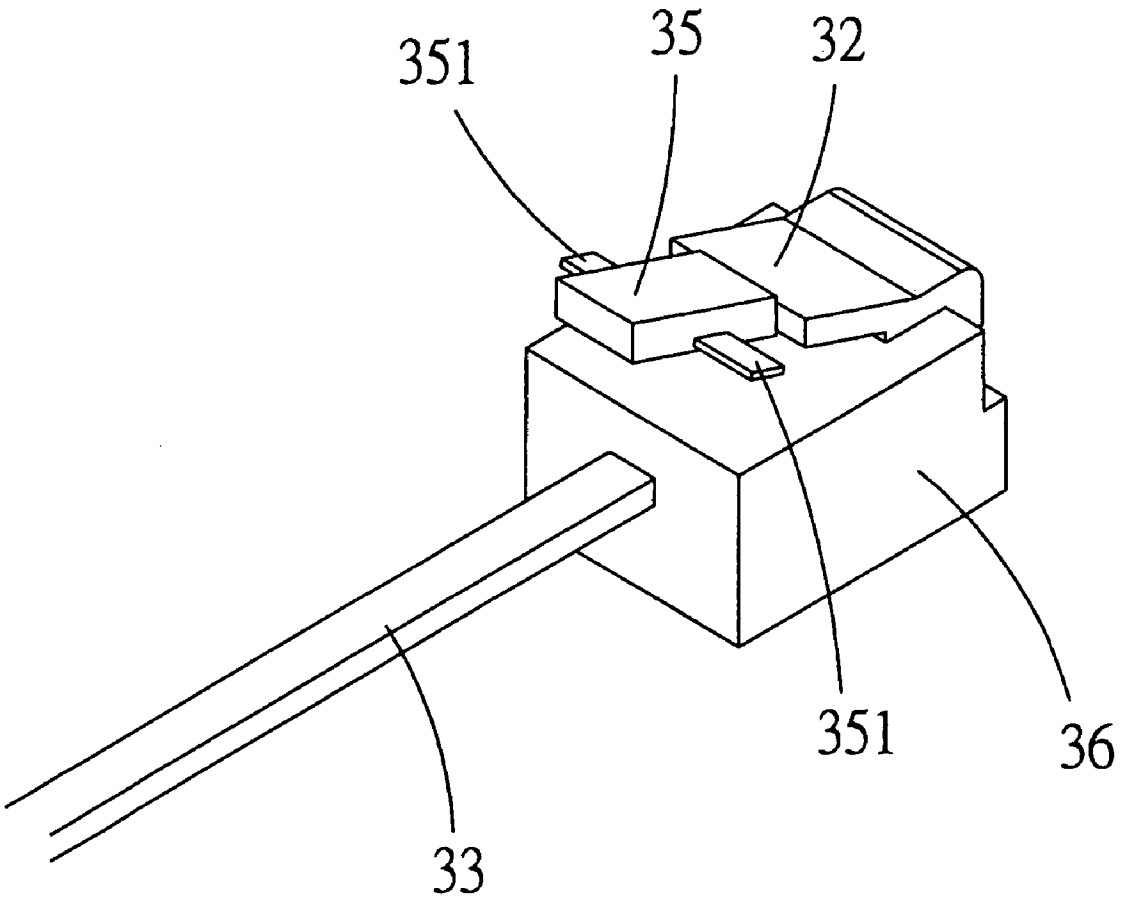
FIG. 7 is a schematic view about the tenon assembly and the RJ 11 plug according to the present invention.
Figure 8:
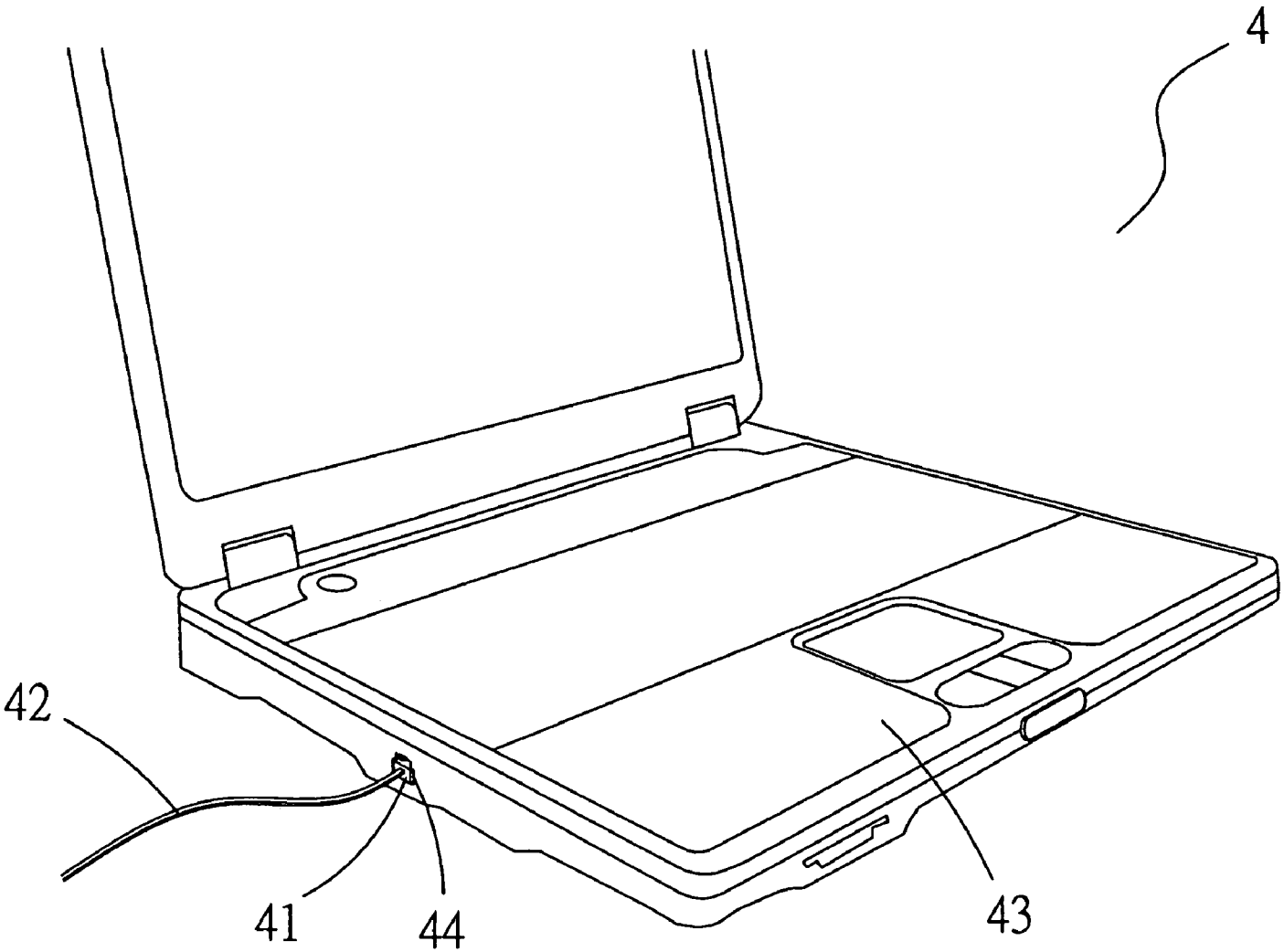
FIG. 8 shows the application of the present invention.

Referring to FIGS. 6 and 7, the another embodiment of the present invention is illustrated. It is illustrated that in the present invention, an RJ 11 plug 36 has a T shape buckle 32. The buckle 32 has a bar 35. Two tenons 351 extends from the bar 35. When the RJ 11 plug 36 is inserted into the insertion hole, the tenons 351 of the bar 35 will press against the insertion hole so that the plug will retain in the insertion hole steadily. With reference to FIG. 8, a further embodiment of the present invention is illustrated. The simple-structured plug for insertion slots of various specifications 4 has an insulating body 41 which can be inserted into an RJ 11 plug 44 of a notebook computer 43 so that the conductive wire 32 is not needed to update a new plug.

Advantages of the present invention will be described herein. The present invention has been made with a unique specification and thus the cost is saved. Thereby the tenons are integral formed with the buckle. Thereby the tenon can be used to a general used telephone wire plug. Furthermore, the present invention can be carried conveniently and the operation of the present invention is simple and easy.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

The invention claimed is:

1. A simple-structured plug for insertion slots of various specifications comprising:

an insulating body having a plurality of terminal slots at a front end thereof for receiving a plurality of terminals; the insulating body having a T shape buckle; the T shape buckle having a transversal portion connected to the insulating body and a longitudinal portion extending from the transversal portion; two tenons extending from two sides of the longitudinal portion of the T shape buckle; wherein when the plug is inserted into a wide insertion hole, the tenon will press against the insertion hole so that the plug will not vibrate, and thus the plug is suitable for insertion holes of various specifications.

2. The simple-structured plug for insertion slots of various specifications as claimed in claim 1, wherein each tenon is one of a protruding block, an elastic sheet and a positioning device.

3. The simple-structured plug for insertion slots of various specifications as claimed in claim 1, wherein the insertion hole is one of an RJ 11 hole and an RJ 45 hole.

4. A simple-structured plug for insertion slots of various specifications comprising:

an insulating body having a plurality of terminal slots at a front end thereof for receiving a plurality of terminals; the insulating body having a T shape buckle; the T shape buckle having a transversal portion connected to the insulating body and a longitudinal portion extending from the transversal portion; a bar having a recess for receiving the longitudinal portion of the T shape buckle; two tenons extending from two sides of the longitudinal portion of the T shape buckle; wherein when the plug is inserted into a wide insertion hole, the tenon will press against the insertion hole so that the plug will not vibrate, and thus the plug is suitable for insertion holes of various specifications.

5. The simple-structured plug for insertion slots of various specifications as claimed in claim 4, wherein each tenon is one of a protruding block, an elastic sheet and a positioning device.

6. The simple-structured plug for insertion slots of various specifications as claimed in claim 4, wherein the insertion hole is one of an RJ 11 hole and an RJ 45 hole.

* * * * *